US010692456B2

(12) United States Patent
Choi et al.

(10) Patent No.: US 10,692,456 B2
(45) Date of Patent: Jun. 23, 2020

(54) DISPLAY DRIVER AND OUTPUT BUFFER

(71) Applicant: SAMSUNG ELECTRONICS CO., LTD., Suwon-si, Gyeonggi-Do (KR)

(72) Inventors: Chul Ho Choi, Seoul (KR); Dip Wu, Taipei (TW); Jason Kuo, Taipei (TW); Jin Soo Kim, Hwaseong-si (KR); Joway Chen, Taipei (TW); Yuwen Chiou, Taipei (TW); Robert Lin, Taipei (TW)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/256,899

(22) Filed: Jan. 24, 2019

(65) Prior Publication Data

US 2020/0043432 A1 Feb. 6, 2020

(30) Foreign Application Priority Data

Aug. 2, 2018 (KR) ..... 10-2018-0090523

(51) Int. Cl.
*G09G 3/36* (2006.01)

(52) U.S. Cl.
CPC ..... *G09G 3/3677* (2013.01); *G09G 3/3648* (2013.01); *G09G 3/3688* (2013.01); *G09G 2310/0294* (2013.01)

(58) Field of Classification Search
CPC .. G09G 3/3648; G09G 3/3677; G09G 3/3688; G09G 2310/0294
See application file for complete search history.

(56) References Cited

U.S. PATENT DOCUMENTS

| | | | | |
|---|---|---|---|---|
| 6,067,066 | A * | 5/2000 | Kubota | G09G 3/2011 345/98 |
| 6,587,934 | B2 | 7/2003 | Miura et al. | |
| 6,993,107 | B2 | 1/2006 | Cranford, Jr. et al. | |
| 7,881,109 | B2 | 2/2011 | Kim | |
| 7,881,198 | B2 | 2/2011 | Kim | |
| 8,314,868 | B2 | 11/2012 | Yamamoto | |
| 8,526,257 | B2 * | 9/2013 | Sutardja | G06F 9/3804 365/203 |
| 8,643,419 | B2 | 2/2014 | Rueger | |
| 9,450,594 | B2 | 9/2016 | Kim et al. | |
| 9,542,872 | B2 * | 1/2017 | Huang | G09G 3/344 |
| 9,589,532 | B2 * | 3/2017 | Park | G09G 5/006 |
| 2010/0022095 | A1 | 1/2010 | Wu et al. | |
| 2010/0220095 | A1 * | 9/2010 | Chiu | G09G 3/3688 345/214 |
| 2013/0127806 | A1 * | 5/2013 | Wu | G09G 3/3688 345/211 |
| 2016/0049133 | A1 * | 2/2016 | Park | G09G 3/3648 345/212 |

* cited by examiner

*Primary Examiner* — Ryan A Lubit
(74) *Attorney, Agent, or Firm* — Volentine, Whitt & Francos, PLLC

(57) ABSTRACT

A display driver includes a first latch storing first image data, a second latch storing second image data, and a buffer unit including a plurality of output buffers outputting a source voltage corresponding to the first image data. Each of the plurality of output buffers includes an input stage, an output stage, and a pre-charge circuit connected between the input stage and the output stage. A pre-charge control unit compares the first image data with the second image data to control the pre-charge circuit.

20 Claims, 15 Drawing Sheets

DISPLAY DRIVER AND OUTPUT BUFFER

CROSS-REFERENCE TO RELATED APPLICATION(S)

This application claims benefit of priority to Korean Patent Application No. 10-2018-0090523 filed on Aug. 2, 2018 in the Korean Intellectual Property Office, the disclosure of which is incorporated herein by reference in its entirety.

BACKGROUND

1. Field

The present disclosure relates to a display driver and an output buffer.

2. Description of Related Art

As display devices used in electronic devices, such as TVs, laptop computers, monitors, mobile devices and the like, for displaying images, liquid crystal display (LCD), organic light emitting diode (OLED) display, and the like may be used. Such a display device may include a display panel having a plurality of pixels and a display driver for applying an electrical signal to the plurality of pixels. Images may be implemented by electrical signals provided to the plurality of pixels by the display driver. Thus, various studies into improvements in performance, such as resolution, scan rates, and the like, of display devices, have been undertaken.

SUMMARY

An aspect of the present disclosure is to provide a display driver and an output buffer capable of improving a slew rate of an output terminal of each of output buffers connected to source lines, thereby significantly reducing a problem caused by an increase in a scan rate and resolution of the display device.

A display driver according to an aspect of the present disclosure includes a first latch storing first image data, a second latch storing second image data, and a buffer unit including a plurality of output buffers outputting a source voltage corresponding to the first image data. Each of the plurality of output buffers includes an input stage, an output stage, and a pre-charge circuit connected between the input stage and the output stage. A pre-charge control unit controls the pre-charge circuit comparing the first image data with the second image data to control the pre-charge circuit.

A display driver according to an aspect of the present disclosure includes an output buffer: (1) outputting a first source voltage corresponding to first image data during a first period and (2) outputting a second source voltage corresponding to second image data during a second period subsequent to the first period. A first latch stores the first image data, a second latch stores the second image data, and a pre-charge control unit compares some of the first image data with some of the second image data, bit-by-bit, to increase or decrease an output voltage of the output buffer.

An output buffer according to an aspect of the present disclosure includes an output stage having a first switch element connected between a first power node and an output node and a second switch element connected to a second power node and the output node. The output stage: (1) outputs a first source voltage, corresponding to first image data, during a first period through the output node and (2) outputs a second source voltage corresponding to second image data during a second period subsequent to the first period. A first pre-charge element is connected between a control terminal of the first switch element and the second power node. A second pre-charge element is connected between a control terminal of the second switch element and the first power node.

According to an embodiment of the disclosure, a display driver includes a buffer having a pre-charge circuit and an output stage. A pre-charge processor controls the pre-charge circuit to pre-charge the output stage to a pre-charge voltage: (1) determined by both first image data and second image data, and (2) subsequent to outputting a first voltage representing the first image data and prior to outputting a second voltage representing the second image data.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, example embodiments of the present disclosure will be described with reference to the accompanying drawings.

Figure 1:
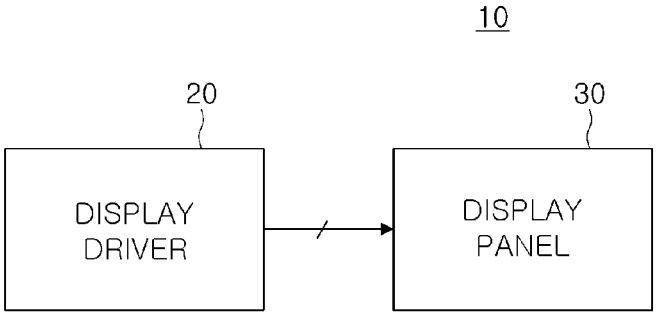
FIG. 1 is a block diagram illustrating a display device including a display driver according to an example embodiment of the present disclosure.

FIG. 1 is a block diagram illustrating a display device including a display driver according to an example embodiment of the present disclosure. Referring to FIG. 1, a display device 10 according to an example embodiment of the present disclosure may include a display driver 20 and a display panel 30.

The display driver 20 may include a gate driver and a source driver for inputting image data transmitted by an external processor to the display panel 30, a timing controller controlling the gate driver and the source driver, and the like. The timing controller may control the gate driver and the source driver in response to a vertical synchronization signal and a horizontal synchronization signal.

A processor transmitting image data to the display driver 20 may be an application processor AP, in the case of a mobile device, and a central processing unit CPU, in the case of a desktop computer, a laptop computer, a television, or the like. For example, the processor may be understood as a processing device having an arithmetic function. The processor may generate image data to be displayed through the display device 10 or may receive image data from a memory, a communication module, or the like to transmit the image data to the display driver 20.

Figure 2:
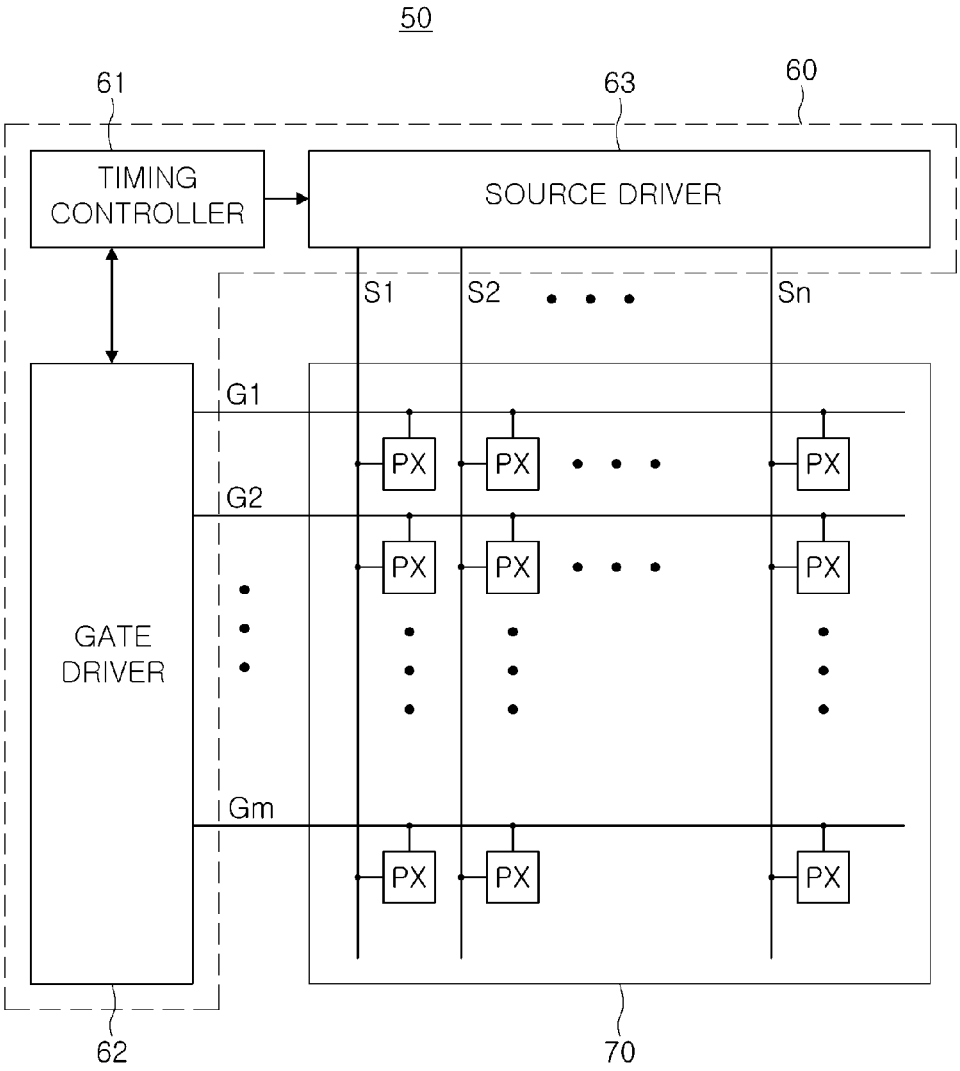
FIG. 2 is a block diagram illustrating a display device including a display driver according to another example embodiment of the present disclosure.

FIG. 2 is a block diagram illustrating a display device including a display driver according to an example embodiment of the present disclosure.

Referring to FIG. 2, a display device 50 may include a display driver 60 and a display panel 70. The display driver 60 may include a timing controller 61, a gate driver 62, a source driver 63, and the like. The display panel 70 may include a plurality of pixels PX disposed along a plurality of gate lines G1 to Gm and a plurality of source lines S1 to Sn.

In an example embodiment, the display device 50 may display an image on a frame-by-frame basis. Time required to display a single frame may be defined by a vertical period, and the vertical period may be determined by a scan rate of the display device 50. In an example embodiment, when the scan rate of the display device 50 is 60 Hz, the vertical period may be 1/60 second, about 16.7 msec.

During one vertical period, the gate driver 62 may scan each of the plurality of gate lines G1 to Gm. Time during which the gate driver 62 scans each of the plurality of gate lines G1 to Gm may be defined as a horizontal period, and during one horizontal period, the source driver 63 may input a source voltage to the pixels PX. The source voltage may be a voltage output by the source driver 62, based on image data, and the brightness of respective pixels PX may be determined by the source voltage.

Figure 3:
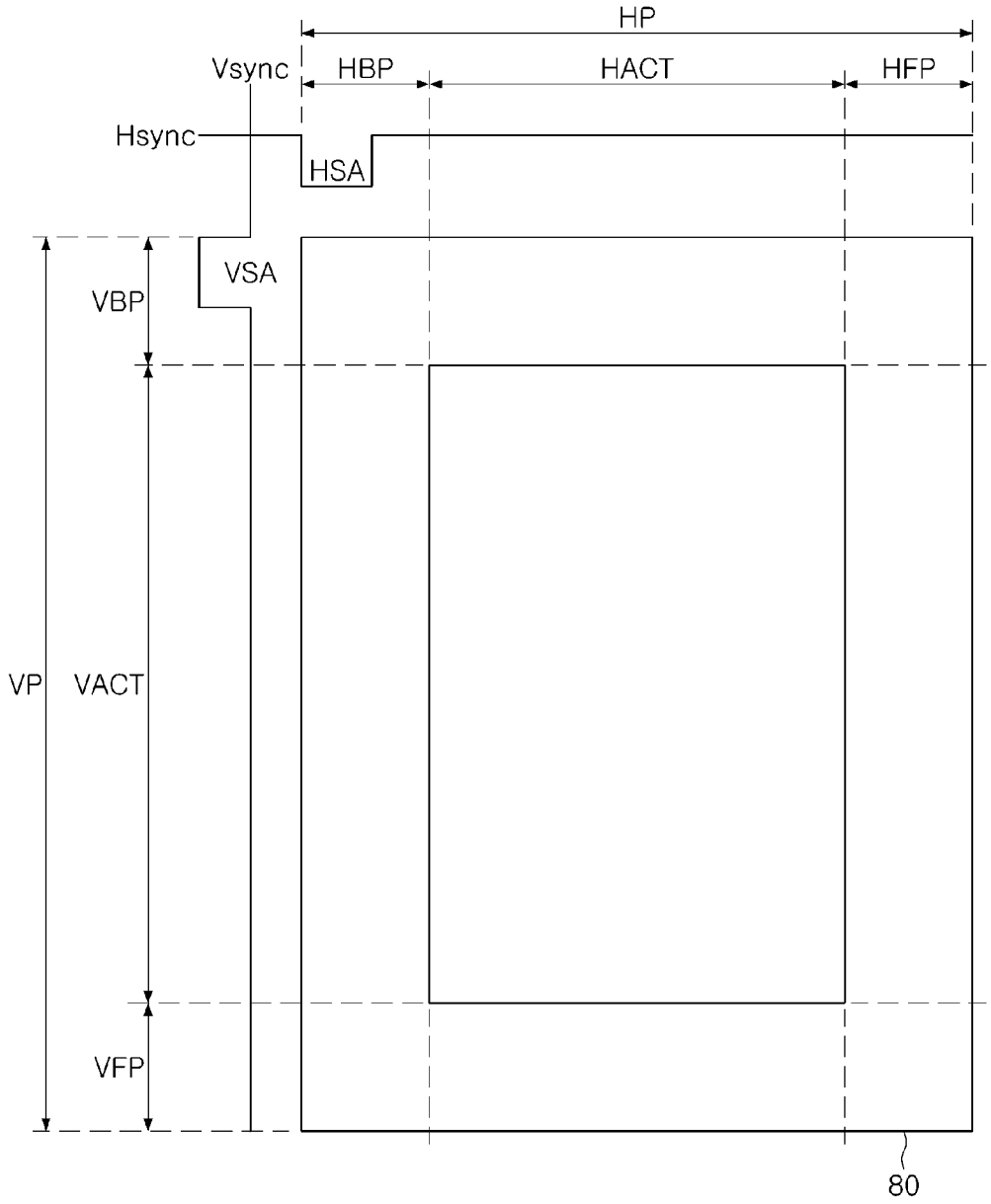
FIG. 3 is a diagram illustrating an operation of a display device according to an example embodiment of the present disclosure.

FIG. 3 is a diagram illustrating an operation of a display driving device according to an example embodiment of the present disclosure.

Referring to FIG. 3, a display panel 80 may operate by a vertical synchronization signal Vsync having a vertical period VP and a horizontal synchronization signal Hsync having a horizontal period HP. For example, the vertical period VP may include a first vertical porch period VBP, a vertical active period VACT, and a second vertical porch period VFP The first vertical porch period VBP may include a vertical speed action period VSA. In an example embodiment, the first vertical porch period VBP may be a vertical back porch period, and the second vertical porch period VFP may be a vertical front porch period.

The horizontal period HP may include a first horizontal porch period HBP, a horizontal active period HACT, and a second horizontal porch period HFP. The first horizontal porch period HBP may include a horizontal speed action period HSA. In an example embodiment, the first horizontal porch period HBP may be a horizontal back porch period, and the second horizontal porch period HFP may be a horizontal front porch period.

Scans for a plurality of gate lines included in the display panel 80 and a data input for pixels connected to the scanned gate lines may be performed in the vertical and horizontal active periods VACT and HACT. For example, the gate lines may be sequentially scanned during the vertical active period VACT and data input for the pixels connected to the scanned gate lines may be performed during the horizontal active period HACT.

There has been a trend for the scan rate and the resolution of the display panel 80 to be gradually increased, and thus the vertical period VP and the horizontal period HP may be reduced thereby. In the case in which the vertical period VP and the horizontal period HP are reduced, the source driver may be required to input image data to pixels within a short time, and, for this, output buffers outputting source voltages may be required to operate at a high speed. In other words, the output voltage of the output buffers may be rapidly increased or decreased. A pre-charge function increasing or decreasing the output voltage of the output buffers in advance may be used to rapidly increase or decrease the output voltage of the output buffers.

The source driver may receive a plurality of gamma voltages together with image data and may provide at least some of the plurality of gamma voltages to the output buffers as an input voltage, based on the image data. Each of the output buffers may include an input stage for receiving gamma voltages and an output stage outputting the source voltage. The gamma voltages input to the input stage of each of the output buffers may be determined by image data received by a decoder unit of the source driver.

As described above, since the horizontal period HP of the display panel 80 is reduced to require high-speed output buffers, the pre-charge function for rapidly increasing or decreasing the output voltage of the output buffer may be employed. A typical pre-charge function may be implemented by a pre-charge circuit which is connected between an output terminal of the output buffer and a source line of the display panel 80. However, when the pre-charge circuit is connected between the output terminal of the output buffer and the source line, control of the pre-charge circuit may be difficult due to a feedback delay of the output buffer, or the like. In addition, a comparison circuit comparing an input voltage and an output voltage of the output buffer with each other may be provided to determine whether the pre-charge circuit has increased or decreased the output voltage of the output buffer. To significantly reduce an offset of the comparison circuit, the size of the input stage of the output buffer may increase.

In an example embodiment of the present disclosure, to solve the above-described problems, the pre-charge circuit may be connected between the input stage and the output stage of the output buffer. The pre-charge circuit may include a plurality of pre-charge elements, and, in an example embodiment, the plurality of pre-charge elements may be controlled by different control signals. According to an example embodiment of the present disclosure, as the pre-charge circuit is provided, the problem of increasing the input stage of the output buffer may be solved. Also, the slew rate of the output terminal of the output buffer may be improved and the power consumption due to the operation of the pre-charge circuit may be significantly reduced.

Figure 4:
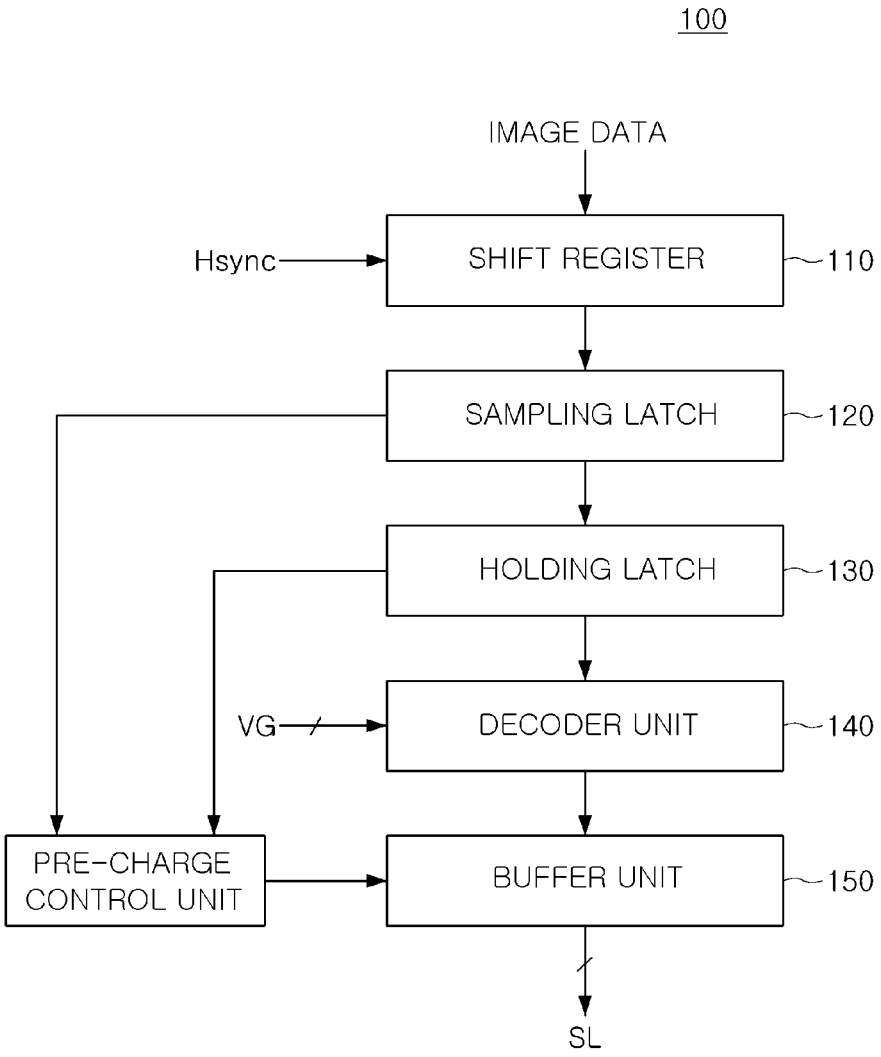
FIG. 4 is a block diagram illustrating a display driver according to an example embodiment of the present disclosure.

FIG. 4 is a block diagram illustrating a display driver according to an example embodiment of the present disclosure.

Referring to FIG. 4, a display driver 100 according to an example embodiment of the present disclosure may include a shift register 110, a sampling latch 120, a holding latch 130, a decoder unit 140, a buffer unit 150, a pre-charge control unit 160, and the like. The shift register 110, the sampling latch 120, the holding latch 130, the decoder unit 140, and the buffer unit 150 may be components included in the source driver of the display driver 100.

The shift register 110 may control operation timings of each of a plurality of sampling circuits included in the sampling latch 120, in response to a horizontal synchronization signal Hsync. The horizontal synchronization signal Hsync may be a signal having a predetermined period. The sampling latch 120 may sample image data according to a shift order of the shift register 110. The image data sampled by the sampling latch 120 may be stored in the holding latch 130.

The decoder unit 140 may include a digital-to-analog converter DAC and may receive the plurality of gamma voltages VG. In an example embodiment, the number of the plurality of gamma voltages VG may be determined depending on the number of bits of the image data. For example, when the image data is 8-bit data, the number of the plurality of gamma voltages VG may be 256 or less, and when the image data is 10-bit data, the number of the plurality of gamma voltages VG may be 1024 or less. The decoder unit 140 may select at least one of the plurality of gamma voltages VG, based on the image data stored in the holding latch 130.

The buffer unit 150 may include a plurality of output buffers implemented by an operational amplifier, and the plurality of output buffers may be connected to a plurality of source lines SL. Each of the plurality of output buffers may include a plurality of input terminals. The decoder unit 140 may select at least some of the plurality of gamma voltages VG, based on the image data, and may provide the selected gamma voltage to the input terminals of each of the plurality of output buffers, as an input voltage. Each of the plurality of output buffers may output the input voltage received from the decoder unit 140 as a source voltage.

In an example embodiment of the present disclosure, each of the plurality of output buffers may include a pre-charge circuit. The operation of the pre-charge circuit may be controlled by a pre-charge control unit 160. The pre-charge control unit 160 may compare the image data stored in the sampling latch 120 and the image data stored in the holding latch 130 with each other to control the pre-charge circuit.

For example, the image data stored in the holding latch 130 may be first image data corresponding to a first source voltage in which each of the plurality of output buffers outputs during a current first period. In addition, the image data stored in the sampling latch 120 may be second image data corresponding to a second source voltage in which each of the plurality of output buffers is to be output during a second period subsequent to the first period. The pre-charge circuit may compare the first image data with the second image data to generate control data, and may control the pre-charge circuit, based on the control data.

For example, the pre-charge control unit 160 may compare the first image data with the second image data bit-by-bit to generate the control data. In addition, to reduce an operation amount and increase an operation speed, the control data may be generated by comparing some of bits of the first image data and some of bits of the second image data with each other. The number of bits of the control data may be smaller than the number of bits of each of the first image data and the second image data.

Figure 5:
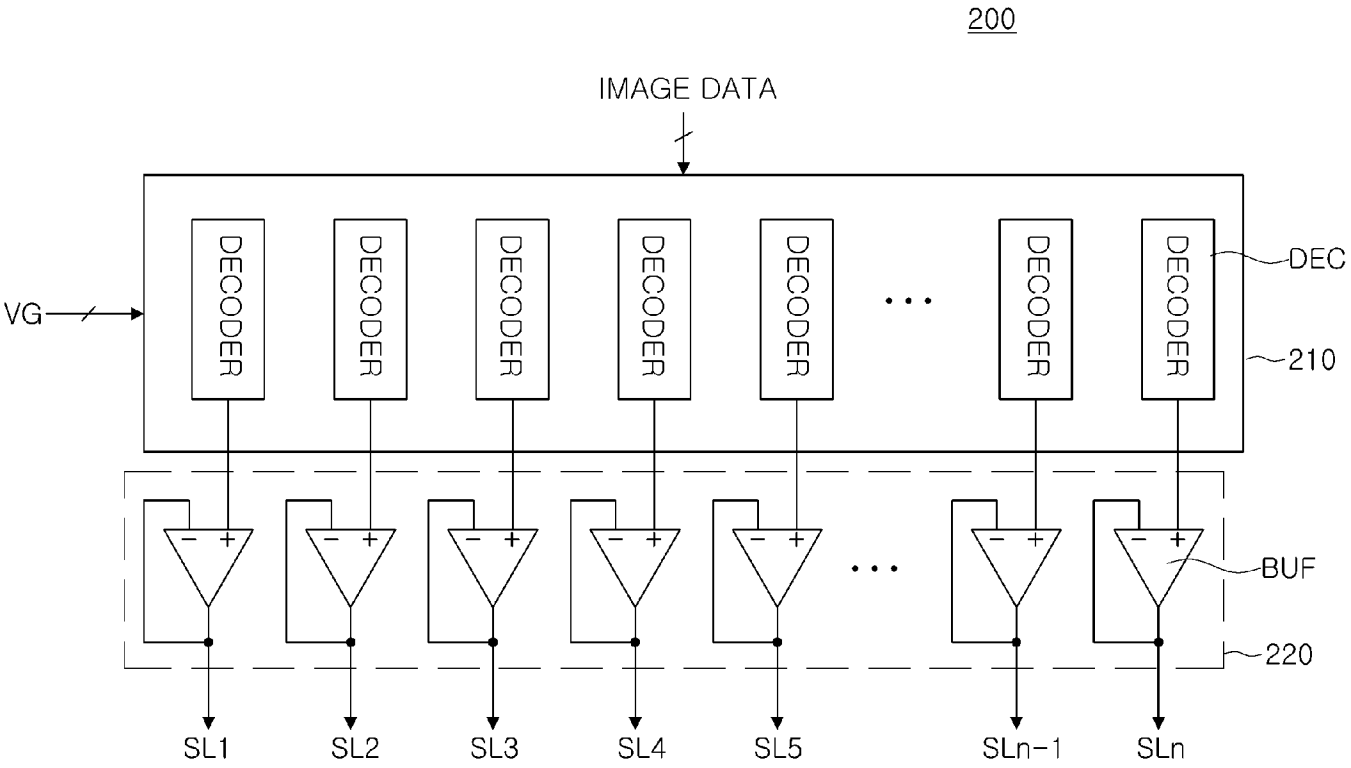
FIG. 5 illustrates a source driver, included in a display driver, having a decoder unit and a buffer unit, according to an example embodiment.
Figure 6:
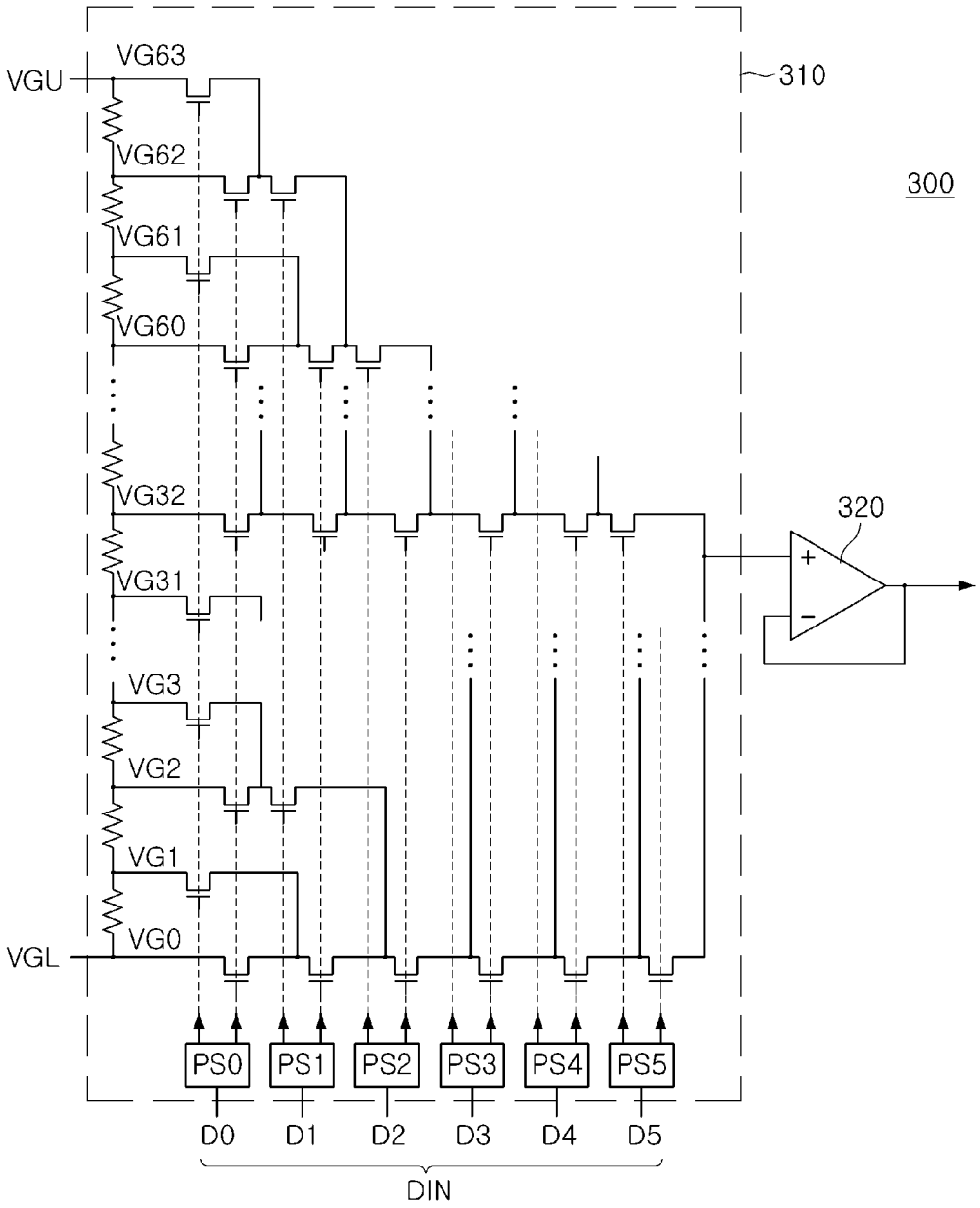
FIG. 6 illustrates a source driver, included in a display driver, having a decoder and an output buffer, according to an example embodiment.

FIGS. 5 and 6 are diagrams illustrating a structure of a source driver included in a display driver according to an example embodiment of the present disclosure.

First, referring to FIG. 5, a source driver 200 according to an example embodiment may include a decoder unit 210 and a buffer unit 220. The decoder unit 210 may include a plurality of decoders DEC and may receive a plurality of gamma voltages VG together with image data. As described above, the number of the plurality of gamma voltages VG may be determined depending on the number of bits of the image data. When the image data has N bits, the number of the plurality of gamma voltages VG input to the decoder unit 210 may be $2^N$ or less.

The buffer unit 220 may include a plurality of output buffers BUF. Referring to FIG. 5, the output buffer BUF may include an operational amplifier, and may have a negative feedback structure in which an output terminal and an inverting input terminal of the operational amplifier are connected to each other. The decoder DEC may select at least one of the plurality of gamma voltages VG to provide the selected gamma voltage to a noninverting input terminal of the operational amplifier as an input voltage. An output terminal of the operational amplifier may be connected to one of the source lines SL1 to SLn, and the magnitude of the source voltage output from the operational amplifier may be determined by the voltage input to the noninverting input terminal.

Referring to FIG. 6, a source driver 300 may include a decoder 310 and an output buffer 320. The decoder 310 may receive a plurality of gamma voltages VG0 to VG63 and image data DIN. In an example embodiment illustrated in FIG. 6, the image data DIN may be 6-bit data, comprising data D0-D5, and the plurality of gamma voltages VG0 to VG63 may have 64 different magnitudes, ranging from a lower gamma voltage VGL to an upper gamma voltage VGU.

The decoder 310 may include a plurality of switch elements, and the plurality of switch elements may be turned-on or turned-off according to values of respective bits of the image data DIN. For example, when the bits of the image data DIN are all 0, the switch elements connected to a lowest gamma voltage VG0 are all turned-on such that the lowest gamma voltage VG0 may be input to an output buffer 320. The decoder 310 may include switch controllers PS0 to PS5 for controlling the plurality of switch elements, based on the value of the image data DIN.

Figure 7:
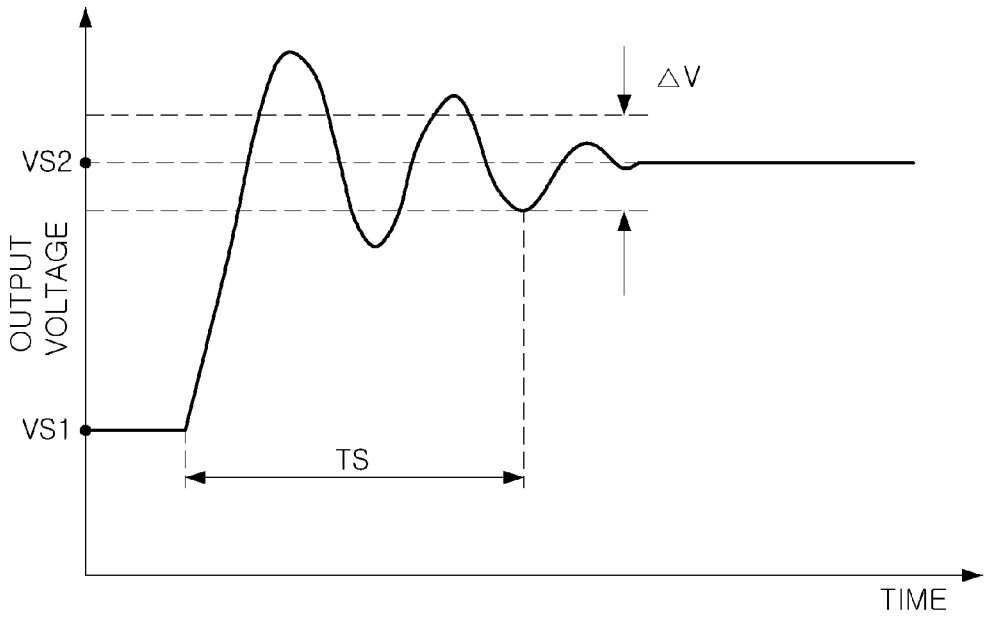
FIG. 7 is a diagram illustrating an operation of an output buffer according to an example embodiment of the present disclosure.

FIG. 7 is a diagram illustrating an operation of an output buffer according to an example embodiment of the present disclosure.

FIG. 7 may be a graph illustrating an output voltage of an output buffer included in a source driver. The graph illustrated in FIG. 7 may correspond to an example embodiment in which the output voltage of the output buffer increases. Referring to FIG. 7, the output voltage of the output buffer may increase from a first source voltage VS1 to a second source voltage VS2. The output voltage may be repeatedly increased and decreased during a predetermined setting time TS and may be maintained at the second source voltage VS2, ±ΔV, after the setting time TS has elapsed.

The slew rate of the output buffer may be determined at a speed at which the output voltage increases at the beginning of the setting time TS. When the slew rate of the output buffer is low, as described above, the display device may be unsatisfactory for use with a high resolution and scan rate. To increase the slew rate of the output buffer, the performance of the output buffer may be increased by increasing the power voltage supplied to the output buffer, which may increase the power consumption of the display driver.

Therefore, in the present disclosure, the output voltage of the output buffer may be rapidly increased or decreased, without increasing the power consumption of the display driver by applying the pre-charge function to the output buffer. In addition, in an example embodiment of the present disclosure, a pre-charge circuit may be connected between the input stage and the output stage of the output buffer. In other words, by connecting the pre-charge circuit within the output buffer and turning the pre-charge elements included in the pre-charge circuit on or off with different control signals, various trade-offs due to addition of the pre-charge circuit may be overcome.

Figure 8:
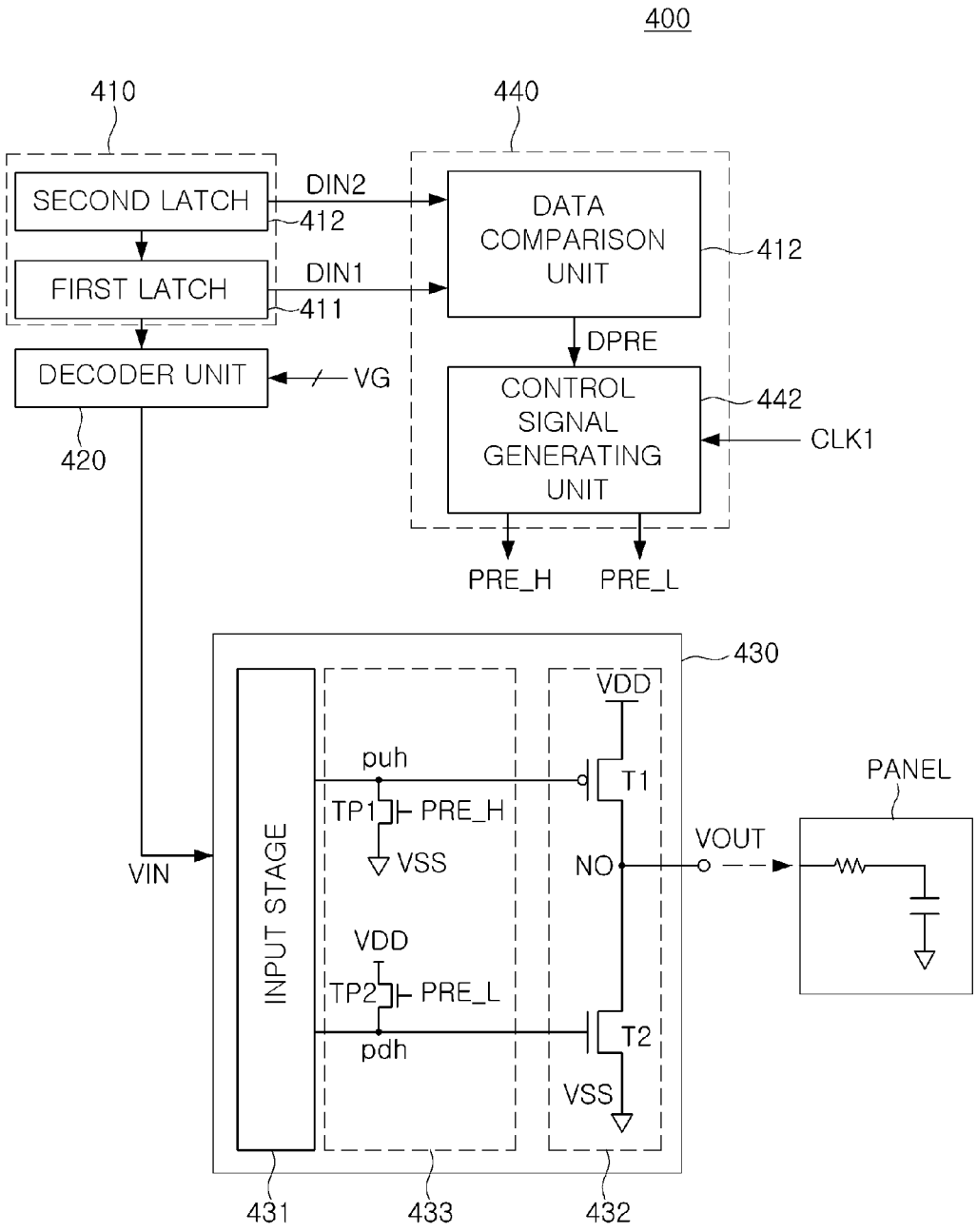
FIG. 8 is a diagram illustrating an operation of a display driver according to an example embodiment of the present disclosure.

FIG. 8 is a diagram illustrating an operation of a display driver according to an example embodiment of the present disclosure.

Referring to FIG. 8, a display driver 400 according to an example embodiment of the present disclosure may include a latch unit 410, a decoder unit 420, a buffer unit 430, a pre-charge control unit 440, and the like. The latch unit 410 may include a first latch 411 and a second latch 412, each of the first latch 411 and the second latch 412 may store first image data DIN1 [7:0] and second image data DIN2 [7:0]. The first latch 411 may be a holding latch, and the second latch 412 may be a sampling latch.

The first image data DIN1 [7:0] may be data corresponding to a first source voltage which the buffer unit 430 outputs to the display panel during a first period. The second image data DIN2 [7:0] may be data corresponding to a second voltage to be output to the display panel by the buffer unit 430 during a second period subsequent to the first period. Thus, the first image data DIN1 [7:0] and the second image data DIN2 [7:0] may be different from each other.

In an example embodiment illustrated in FIG. 8, it is assumed that each of the first image data DIN1 [7:0] and the second image data DIN2 [7:0] is 8-bit data, but is not limited thereto. In an example embodiment illustrated in FIG. 8, the plurality of gamma voltages VG input to the decoder unit 420 may be 256 or less. The decoder unit 420 may select at least one of the plurality of gamma voltages VG as an input voltage VIN, based on the first image data DIN1 [7:0].

The buffer unit 430 may include a plurality of output buffers, each of the plurality of output buffers may be connected to one of the plurality of source lines included in the display panel. The output buffer may include an input stage 431, an output stage 432, and a pre-charge circuit 433. The pre-charge circuit 433 may be connected between the input stage 431 and the output stage 432 and may include a first pre-charge element TP1 and a second pre-charge element TP2. The first pre-charge element TP1 and the second pre-charge element TL2 may be turned-on or turned-off by a first pre-charge control signal Pre_H and a second pre-charge control signal Pre_L output by the pre-charge control unit 440, respectively.

The output stage 432 may include a first switch element T1 receiving a first power voltage VDD and a second switch element T2 receiving a second power voltage VSS, and an output voltage VOUT thereof may be input to the display panel through an output node NO between the first switch element T1 and the second switch element T2. In an example embodiment, the first switch element T1 may be a positive-channel metal-oxide semiconductor (PMOS) transistor, and the second switch element T2 may be a negative-channel metal-oxide semiconductor (NMOS) transistor. The turning-on and turning-off of each of the first switch element T1 and the second switch element T2 may be controlled by a voltage transmitted from the input stage 431 or the pre-charge circuit 433. The first pre-charge element TP1 may be an NMOS transistor such as the second switch element T2, and the second pre-charge element TP2 may be a PMOS transistor such as the first switch element T1.

When the first pre-charge element TP1 is turned-on, the gate voltage (puh) of the first switch element T1 may be reduced such that the first switch element T1 may be turned-on. Therefore, the first power voltage VDD may be input to the output node NO, and the output voltage VOUT may be increased. Conversely, when the second pre-charge element TP2 is turned-on, the gate voltage (pdh) of the second switch element T2 may be increased such that the second switch element T2 may be turned-on. Therefore, the second power voltage VSS may be input to the output node NO and the output voltage VOUT may be reduced. In other words, in an example embodiment of the present disclosure, the pre-charge function of increasing or decreasing the output voltage VOUT by turning the first pre-charge element TP1 and the second pre-charge element TP2 on or off may be implemented.

As described above, the first pre-charge element TP1 and the second pre-charge element TP2 may be controlled by the first pre-charge control signal Pre_H and the second pre-charge control signal Pre_L, respectively, output from the pre-charge control unit 440. For example, the turn-on time and the turn-off time of each of the first pre-charge element TP1 and the second pre-charge element TP2 may be changed such that the magnitude in which the output voltage VOUT has increased or decreased may be adjusted by the pre-charge function. The pre-charge control unit 440 may include a data comparison unit 441 comparing the first image data DIN1 [7:0] with the second image data DIN2 [7:0] to generate control data DPRE [2:0], and a control signal generating unit 442 generating the first pre-charge control signal Pre_H and the second pre-charge control signal Pre_L, based on the control data DPRE [2:0].

In an example embodiment, the data comparison unit 441 may select some of the bits of the first image data DIN1 [7:0] to generate first comparison data and may select some of the bits of the second image data DIN2 [7:0] to generate second comparison data. The data comparison unit 441 may generate control data DPRE [2:0] by comparing the first comparison data with the second comparison data bit-by-bit, and accordingly the number of bits of the control data DPRE [2:0] may be smaller than the number of bits of the first image data DIN1 [7:0] and the second image data DIN2 [7:0]. For example, the data comparison unit 441 may generate the first comparison data and the second comparison data by removing some of lower bits in each of the first image data DIN1 [7:0] and the second image data DIN2 [7:0]. This may be because an influence on the difference between the first image data DIN1 [7:0] and the second image data DIN2 [7:0] may be smaller towards the lower bits.

In addition, the data comparison unit 441 may bind and compare some of the bits of the first comparison data and the second comparison data. Therefore, the number of bits of the control data DPRE [2:0] may be smaller than the number of bits of the first comparison data and the second comparison data, and an operation burden of the data comparison unit 441 may be reduced. Hereinafter, an operation of the display driver 400 will be described in more detail with reference to FIGS. 9 to 10.

Figure 9:
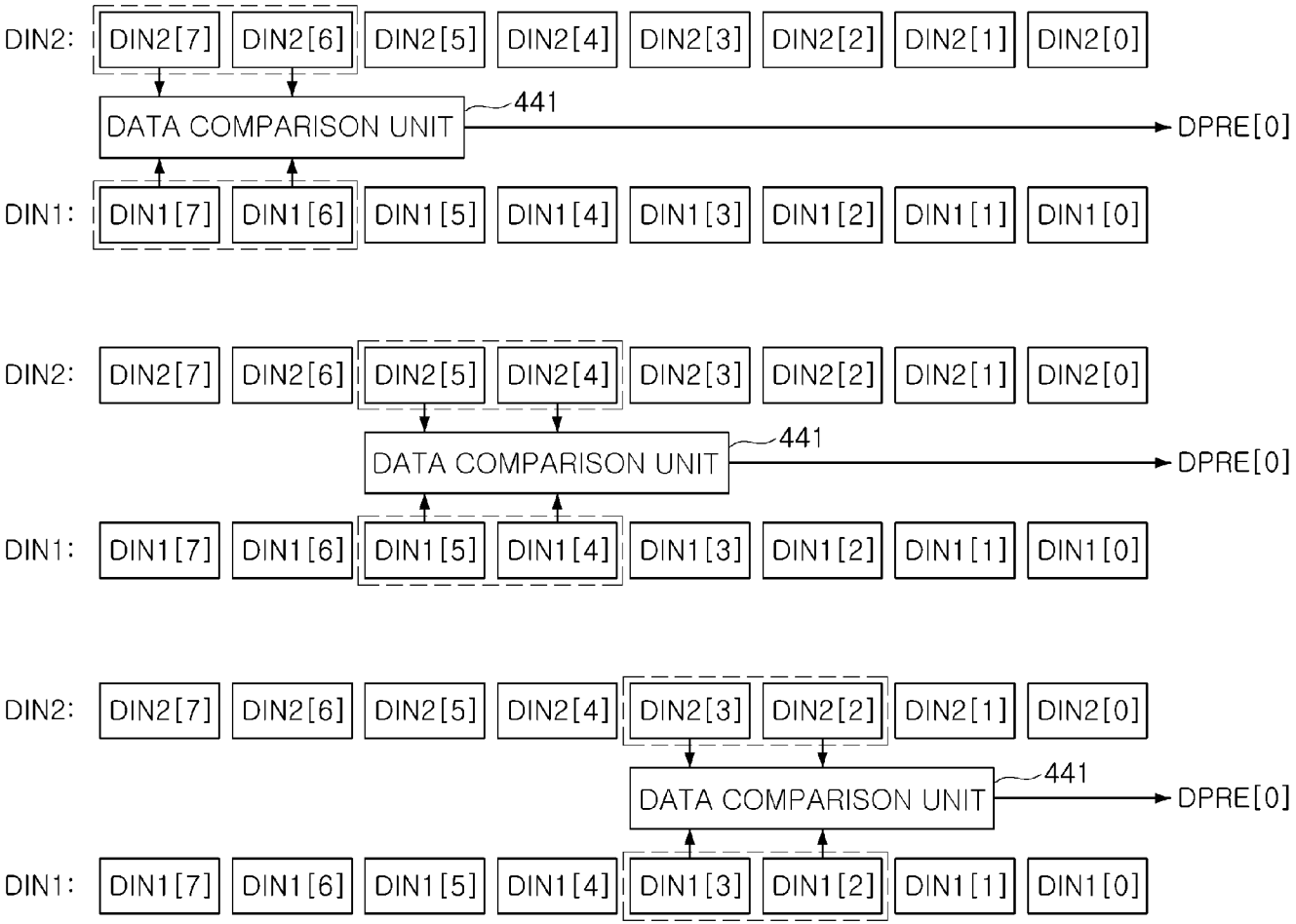
FIGS. 9 and 10 are diagrams illustrating an operation of a display driver according to an example embodiment of the present disclosure.
Figure 10:
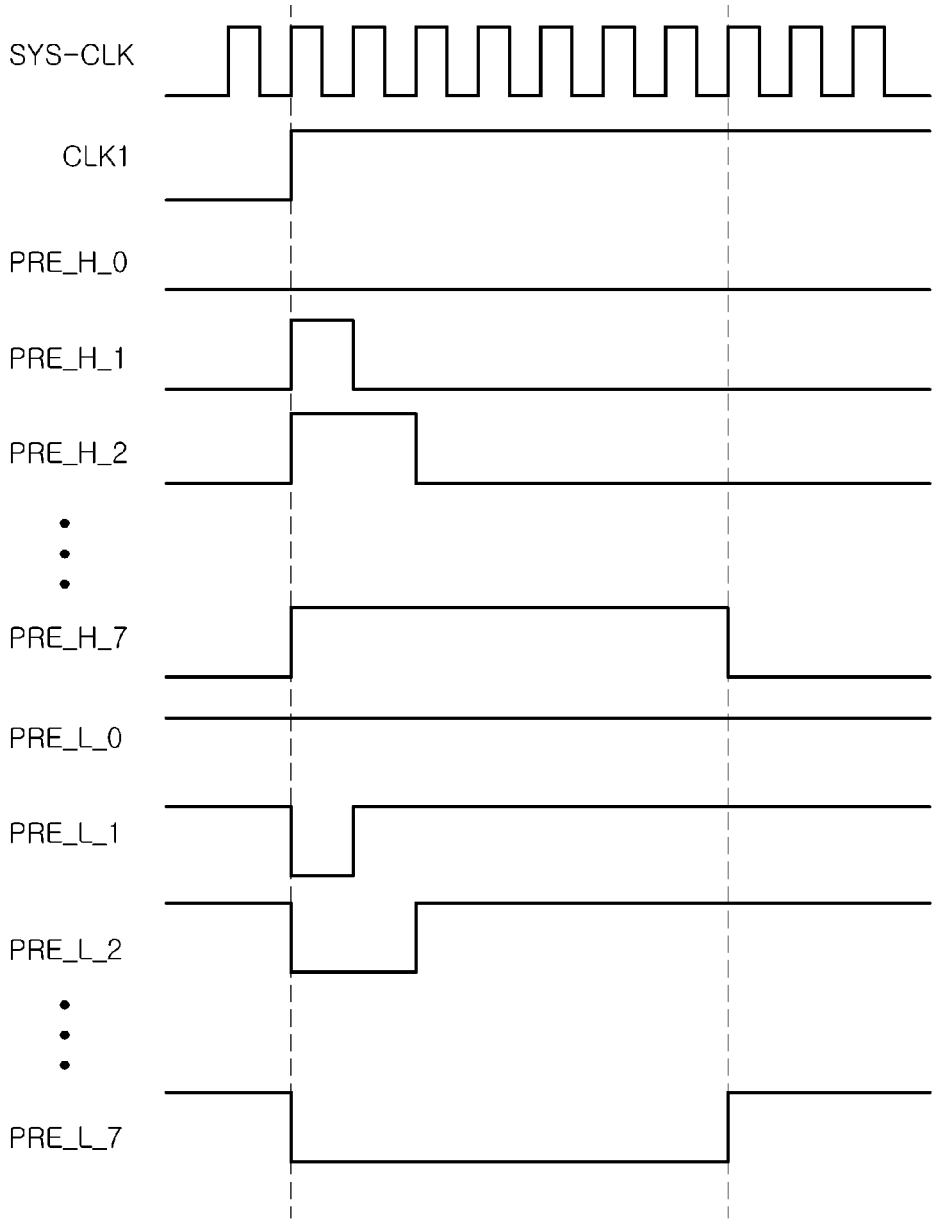

FIGS. 9 and 10 are diagrams illustrating an operation of a display driver according to an example embodiment of the present disclosure.

First, a method in which the data comparison unit 441 generates the control data DPRE [2:0] will be described with reference to FIG. 9. The data comparison unit 441 may receive the first image data DIN1 [7:0] stored in the first latch 411 and the second image data DIN2 [7:0] stored in the second latch 412. The data comparison unit 441 may select some of the first image data DIN1 [7:0] and may select some of the second image data DIN2 [7:0]. In an example embodiment illustrated in FIG. 9, the data comparison unit 441 may select the remaining bits excluding two lower bits in each of the first image data DIN1 [7:0] and the second image data DIN2 [7:0].

To reduce the operation amount, the data comparison unit 441 may group the bits selected from each of the first image data DIN1 [7:0] and the second image data DIN2 [7:0] to compare the bits with each other. Referring to FIG. 9, the data comparison unit 441 may bind two bits adjacent to each other into a group and compare the bits. For example, the data comparison unit 441 may determine the least significant bit DPRE [0] of the control data by comparing seventh and eighth bits DIN1 [7:6] of the first image data DIN1 [7:0] with seventh and eighth bits DIN2 [7:6] of the second image data DIN2 [7:0]. Further, the data comparison unit 441 may determine the second bit DPRE [1] of the control data by comparing fifth and sixth bits DIN1 [4:5] of the first image data DIN1 [7:0] with fifth and sixth bits DIN2 [4:5] of the second image data DIN2 [7:0]. Similarly, the data comparison unit 441 may determine the third bit DPRE [2] of the control data by comparing third and fourth bits DIN1 [2:3] of the first image data DIN1 [7:0] with third and fourth bits DIN2 [2:3] of the second image data DIN2 [7:0].

The control signal generating unit 442 may generate the first pre-charge control signal Pre_H and the second pre-charge control signal Pre_L, with reference to the control data DPRE [2:0] generated by the data comparison unit 441. In an example embodiment, the control signal generating unit 442 may determine the turn-on time and the turn-off time of each of the first pre-charge element TP1 and the second pre-charge element TP2, by adjusting each of the first pre-charge control signal Pre_H and the second pre-charge control signal Pre_L. When the difference between the first image data DIN1 [7: 0] and the second image data DIN2 [7: 0] is large, the control signal generating unit 442 may turn-on the first pre-charge device TP1 or the second pre-charge device TP2 for a long time to set the pre-charge time to be relatively long. Therefore, the increase or decrease of the output voltage VOUT during the pre-charge time may be increased.

FIG. 10 is a diagram illustrating a method of generating the first pre-charge control signal Pre_H and the second pre-charge control signal Pre_L. In an example embodiment illustrated in FIG. 10, a system clock signal SYS_CLK may be a clock signal used inside the display driver 400. A first clock signal CLK1 is a clock signal input to the pre-charge control unit 440 and may have a frequency lower than the system clock signal SYS_CLK. At a rising edge of the first clock signal CLK1, the output buffer 430 may output the output voltage VOUT to the display panel.

Referring to FIG. 10, the first pre-charge control signal Pre_H and the second pre-charge control signal Pre_L may be determined by the control data DPRE [2:0]. Since the control data DPRE [2:0] has three bits, each of the first pre-charge control signal Pre_H and the second pre-charge control signal Pre_L may be selected from eight different signals.

For example, when the control signal generating unit 442 selects the first pre-charge control signal Pre_H as a first signal Pre_H_0 and the second pre-charge control signal Pre_L as an eighth signal Pre_L_7, the output node NO may continue to receive the second power voltage VSS during the pre-charge time. Thus, the output voltage VOUT may be reduced a maximum amount during the pre-charge time. On the other hand, when the control signal generating unit 442 selects the first pre-charge signal as the first signal Pre_H_0 and the second pre-charge control signal Pre_L as the second signal Pre_L_1, the output node NO may receive the second power voltage VSS only for a short time. Therefore, the output voltage VOUT may be slightly reduced during the pre-charge time.

When the control signal generating unit 442 selects the first pre-charge control signal Pre-_H as the eighth signal Pre_H_7 and the second pre-charge control signal Pre_L as the first signal Pre_L_0, the output node NO may continue to receive the first power voltage VDD during the pre-charge time. Thus, the output voltage VOUT may be increased a maximum amount during the pre-charge time. On the other hand, when the control signal generating unit 442 selects the first pre-charge signal as a third signal Pre_H_2 and the second pre-charge control signal Pre_L as the first signal Pre_L_0, the output node NO may receive the first power voltage VDD only for a short time. Therefore, the output voltage VOUT may be slightly increased during the pre-charge time. As described above, the control signal generating unit 442 may increase or decrease the output voltage VOUT during the pre-charge time, by generating the first pre-charge control signal Pre_H and the second pre-charge control signal Pre_L, based on the control data DPRE [2:0].

FIGS. 11 to 14 are diagrams illustrating a pre-charge operation of a display driver according to an example embodiment of the present disclosure. Hereinafter, for convenience of explanation, the display driver illustrated in FIG. 8 will be described together.

Figure 11A:
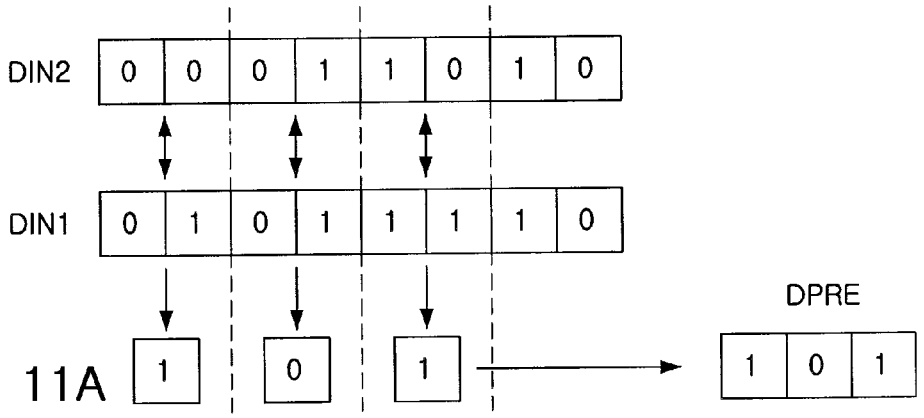
FIGS. 11A, 11B, 11C, and 12 are diagrams illustrating a pre-charge operation of a display driver, in which a voltage of an output stage is decreased, according to an example embodiment of the present disclosure.
Figure 11B:
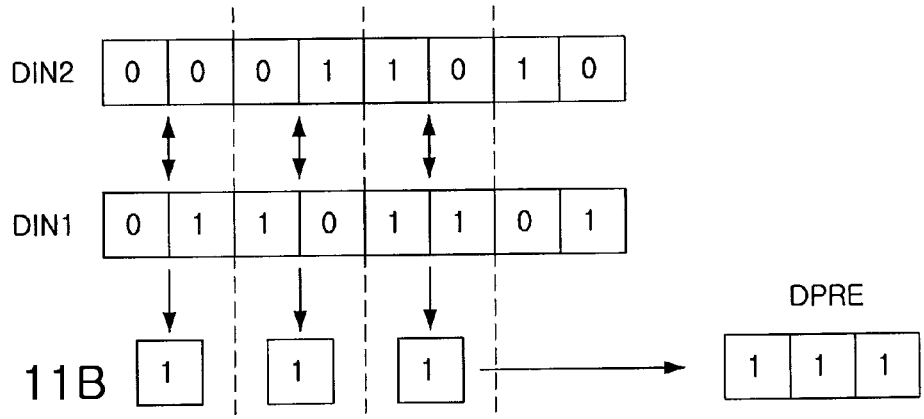
Figure 11C:
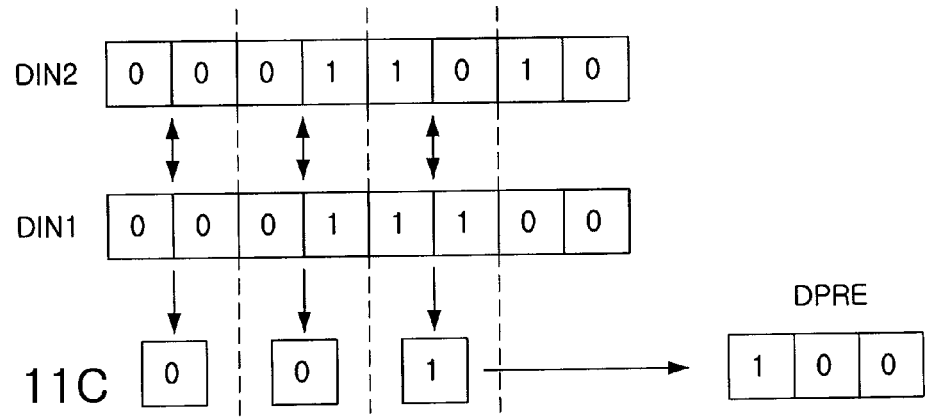
Figure 12:
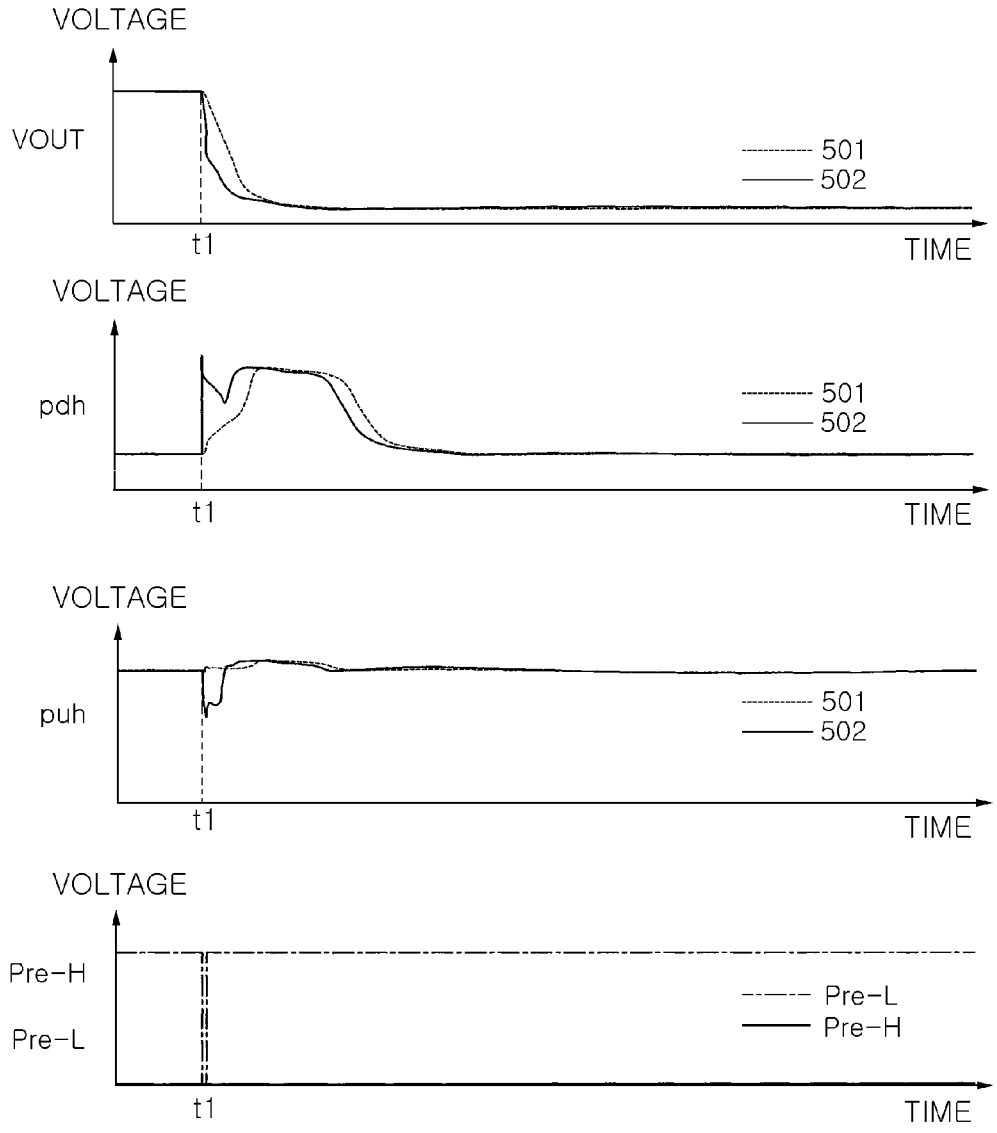

First, FIGS. 11 and 12 may be diagrams illustrating an example embodiment in which the output voltage VOUT of the output buffer 430 is reduced by the pre-charge operation. In example embodiments illustrated in FIGS. 11 and 12, the image data may be 8-bit data, and the output buffer 430 may receive one of 256 different gamma voltages VG0 to VG255.

Referring to FIGS. 11A to 11C, the pre-charge control unit 440 may compare the first image data DIN1 with the second image data DIN2 to generate the control data DPRE. The pre-charge control unit 440 may generate the control data DPRE by comparing some bits of the first image data DIN1 with some bits of the second image data DIN2. Also, the pre-charge control unit 440 may bind some adjacent bits of the first image data DIN1 into one group to compare with similarly bound bits of the second image data DIN2.

Referring to FIG. 11A, a first source voltage corresponding to the first image data DIN1 may be a $95^{th}$ gamma voltage VG94 and a second source voltage corresponding to the second image data DIN2 may be a $27^{th}$ gamma voltage VG26. Therefore, the pre-charge control unit 440 may control the pre-charge circuit 433 in the output buffer 430 such that the output voltage of the output buffer 430 decreases. For example, the pre-charge control unit 440 may turn-off the first pre-charge element TP1 and may turn-on the second pre-charge element TP2, such that the first switch element T1 of the output stage 432 may be turned-off and the second switch element T2 of the output stage 432 may be turned-on. Therefore, the output node NO may receive the second power voltage VSS and the output voltage VOUT may be reduced.

Next, referring to FIG. 11B, a first source voltage corresponding to the first image data DIN1 may be a $110^{th}$ gamma voltage VG109, and a second source voltage corresponding to the second image data DIN2 may be a $27^{th}$ gamma voltage VG26. Thus, the pre-charge control unit 440 may turn-off the first pre-charge element TP1 and may turn-on the second pre-charge element TP2. However, since the difference between the image data DIN1 and DIN2 is greater in an example embodiment illustrated in FIG. 11B, as compared with FIG. 11A, the time for which the second pre-charge element TP2 is turned-on may be relatively longer. In other words, the pre-charge control unit 440 may be generated such that the second pre-charge control signal Pre_L has a low logic value for a longer time.

Referring to FIG. 11C, a first source voltage corresponding to the first image data DIN1 may be a $29^{th}$ gamma voltage VG28 and a second source voltage corresponding to the second image data DIN2 may be a $27^{th}$ gamma voltage VG26. Thus, the pre-charge control unit 440 may turn-off the first pre-charge element TP1 and may turn-on the second pre-charge element TP2. In comparison with FIGS. 11A and 11B, since, in an example embodiment illustrated in FIG. 11C, the difference between the image data DIN1 and DIN2 is small, the time for which the second pre-charge element TP2 is turned-on may be relatively shorter.

FIG. 12 may be a graph illustrating an operation of the output buffer 430 according to an example embodiment described with reference to FIG. 11. Referring to FIG. 12, the output voltage VOUT of the output buffer 430 may decrease from the first time point t1. As illustrated in FIG. 12, in the case of a first example embodiment 501 in which the pre-charge function is activated, the output voltage VOUT may rapidly decrease as compared with the case of a second example embodiment 502 in which the pre-charge function is not activated. This may be because the output voltage VOUT is reduced by the pre-charge circuit 433 regardless of the feedback response delay of the output buffer as the pre-charge function is activated.

Referring to FIG. 12, the first pre-charge control signal Pre_H maintains a low logic value continuously, such that the first pre-charge element TP1 may be kept in the turn-off state. On the other hand, the second pre-charge control signal Pre_L may decrease from a high logic value to a low logic value at the first time point t1, and then increase to a high logic value again. The time during which the second pre-charge control signal Pre_L maintains a low logic value may be determined by the pre-charge control unit 440. While the second pre-charge control signal Pre_L maintains a low logic value, the second pre-charge element TP2 may be turned-on such that the output voltage VOUT may rapidly decrease regardless of the feedback response delay.

The gate voltages (pdh and puh) of each of the first switch element T1 and the second switch element T2 may be changed at the first time point t1, by the first pre-charge control signal Pre_H and the second pre-charge control signal Pre_L. Referring to FIG. 12, at the first time point t1 at which the second pre-charge control signal Pre_L changes to a low logic value, the gate voltage (pdh) of the second switch element T2 may be increased as the second pre-charge element TP2 is turned-on.

Figure 13A:
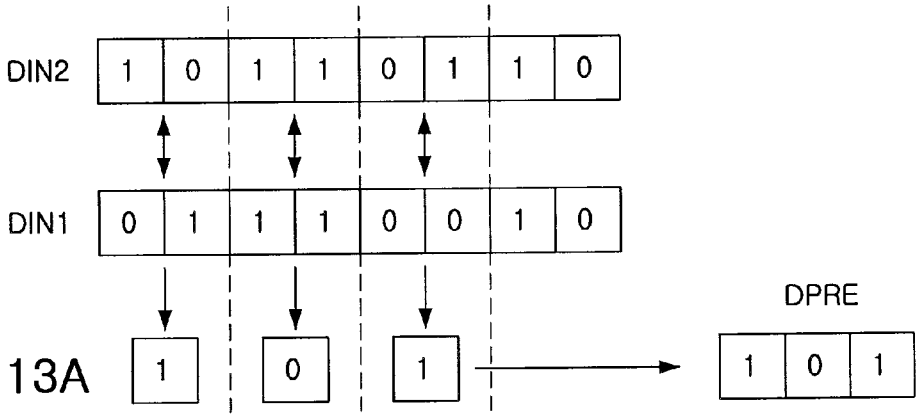
FIGS. 13A, 13B, 13C, and 14 are diagrams illustrating a pre-charge operation of a display driver, in which a voltage of an output stage is increased, according to another example embodiment of the present disclosure.
Figure 13B:
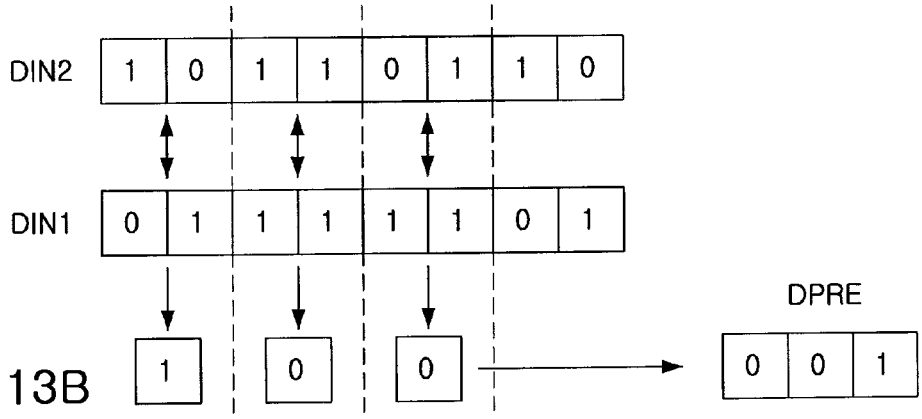
Figure 13C:
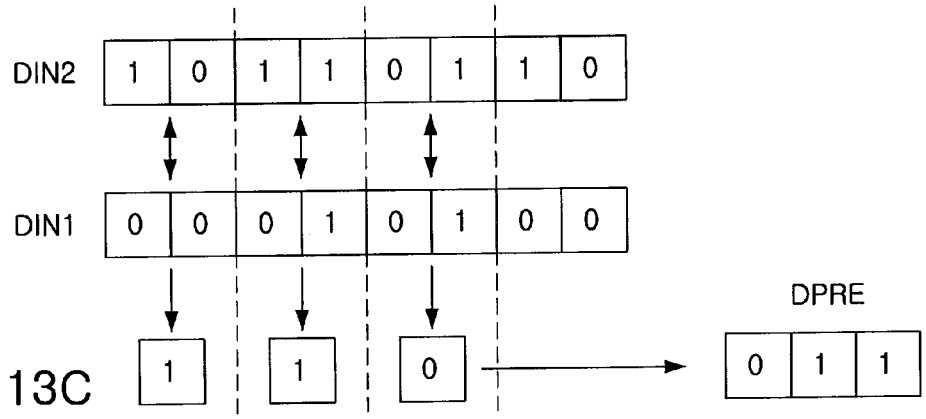
Figure 14:
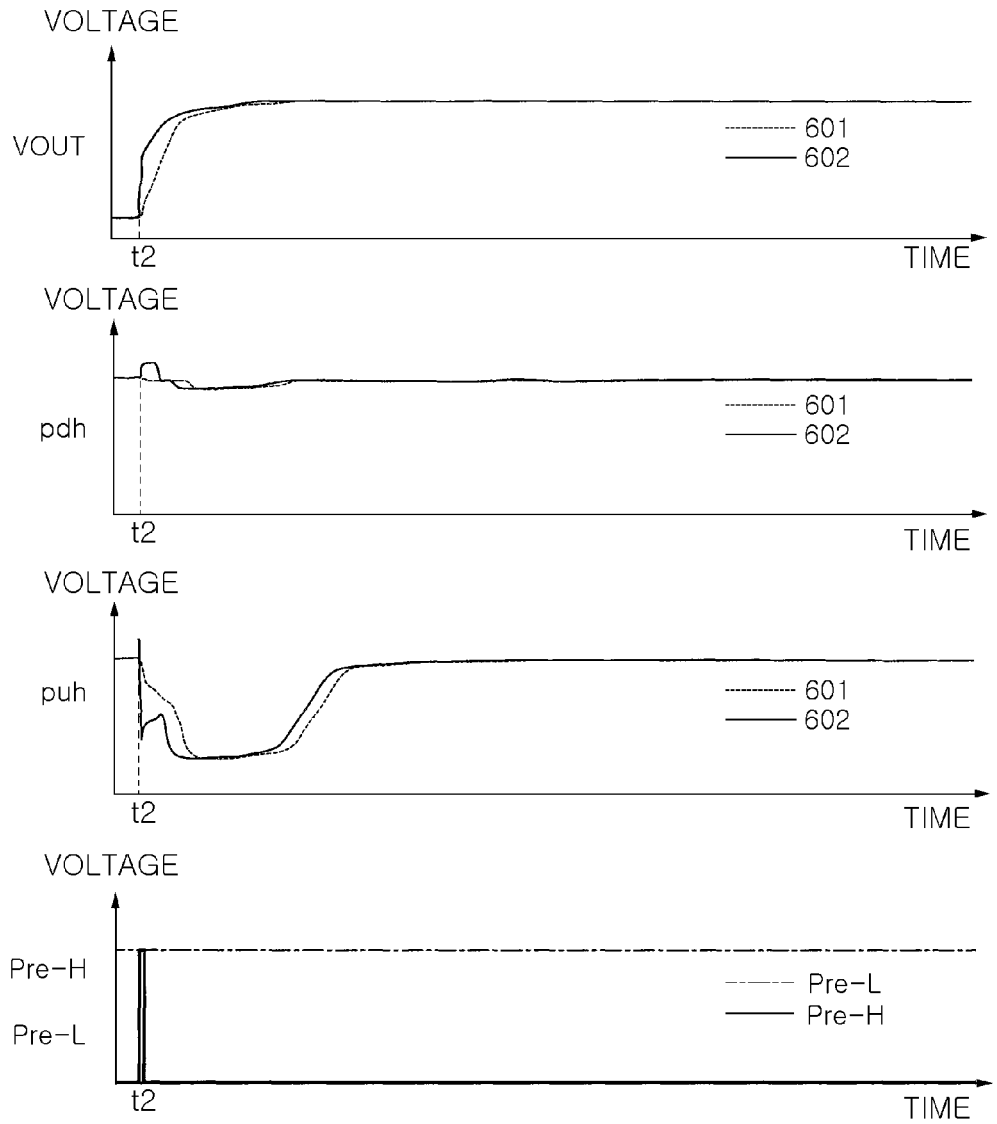

FIGS. 13 and 14 may be diagrams illustrating example embodiments in which the output voltage VOUT of the output buffer 430 is increased by the pre-charge operation. In example embodiments illustrated in FIGS. 13 and 14, the image data may be 8-bit data, and the output buffer 430 may receive one of 256 different gamma voltages VG0 to VG255.

Referring to FIGS. 13A to 13C, the pre-charge control unit 440 may compare the first image data DIN1 with the second image data DIN2 to generate the control data DPRE. The pre-charge control unit 440 may bind some adjacent bits of the first image data DIN1 into one group to compare with similarly bound bits of the second image data DIN2.

First, referring to FIG. 13A, a first source voltage corresponding to the first image data DIN1 may be a $115^{th}$ gamma voltage VG114 and a second source voltage corresponding to the second image data DIN2 may be a $183^{rd}$ gamma voltage VG182. Therefore, the pre-charge control unit 440 may turn-on the first pre-charge element TP1 and turn-off the second pre-charge element TP2, such that the output voltage of the output buffer 430 may be increased. Therefore, the first switch element T1 of the output stage 432 may be turned-on and the second switch element T2 may be turned-off, and the output node NO may receive the first power voltage VDD such that the output voltage VOUT may be increased.

Next, referring to FIG. 13B, a first source voltage corresponding to the first image data DIN1 may be a $126^{th}$ gamma voltage VG125 and a second source voltage corresponding to the second image data DIN2 may be a $183^{rd}$ gamma voltage VG182. Therefore, the pre-charge control unit 440 may turn-on the first pre-charge element TP1 and turn-off the second pre-charge element TP2. However, since the difference between the image data DIN1 and DIN2 is smaller than in an example embodiment illustrated in FIG. 13B as compared with FIG. 13A, the time for which the first pre-charge element TP1 is turned-on may be relatively shorter. In other words, the pre-charge control unit 440 may generate the first pre-charge control signal Pre_H to have a high logic value for a shorter time.

Referring to FIG. 13C, a first source voltage corresponding to the first image data DIN1 may be a $21^{st}$ gamma voltage VG20, and a second source voltage corresponding to the second image data DIN2 may be a $183^{rd}$ gamma voltage VG182. Therefore, the pre-charge control unit 440 may turn-on the first pre-charge element TP1 and turn-off the second pre-charge element TP2. Since the difference between the image data DIN1 and DIN2 is large in an example embodiment illustrated in FIG. 13C as compared with FIGS. 13A and 13B, the time for which the first pre-charge element TP1 is turned-on may be relatively longer.

FIG. 14 may be a graph illustrating an operation of the output buffer 430 according to an example embodiment with reference to FIG. 13. Referring to FIG. 14, the output voltage VOUT of the output buffer 430 may be increased from the second time point t2. As illustrated in FIG. 14, in the case of a first example embodiment 601 in which the pre-charge function is activated, the output voltage VOUT may be increased more rapidly than a second example embodiment 602 in which the pre-charge function is not activated. This may be because, as the pre-charge function is activated, the output voltage VOUT is increased by the pre-charge circuit 433 regardless of the feedback response delay of the output buffer.

Referring to FIG. 14, the second pre-charge control signal Pre_L maintains a high logic value continuously, and therefore the second pre-charge element TP2 may be kept in the turn-on state. On the other hand, the first pre-charge control signal Pre_H may transit from a low logic value to a high logic value at the second time point t2, and thereafter may be changed to the low logic value. The time during which the first pre-charge control signal Pre_H maintains the high logic value may be determined by the pre-charge control unit 440. While the first pre-charge control signal Pre_H maintains the high logic value, the first pre-charge element TP1 may be turned-on such that the output voltage VOUT may be rapidly increased regardless of the feedback response delay.

The gate voltages (pdh and puh) of each of the first switch element T1 and the second switch element T2 may be changed at the second time point t2 by the first pre-charge control signal Pre_H and the second pre-charge control signal Pre_L. Referring to FIG. 14, at the second time point t2 at which the first pre-charge control signal Pre_H changes to a high logic value, the gate voltage (puh) of the first pre-charge element may be reduced, as the first pre-charge element TP1 is turned-on. Therefore, the first switch element T1 may be turned-on and the first power voltage VDD may be supplied to the output node NO at the second time point t2

In other words, in an example embodiment of the present disclosure, the pre-charge circuit may be used to rapidly increase or decrease the output voltage VOUT during the pre-charge period regardless of the feedback response delay of the output buffer. Accordingly, the output buffer having a high slew rate corresponding to an increase in the resolution and the scan rate of the display device, and the like, and a display driver including the same may be implemented. In addition, by connecting the pre-charge circuit between the input stage and the output stage inside the output buffer, rather than between the output terminal of the output buffer and the source line, the increase in a circuit area of the input stage may be significantly reduced and the power consumption of the output buffer may be efficiently managed.

Figure 15:
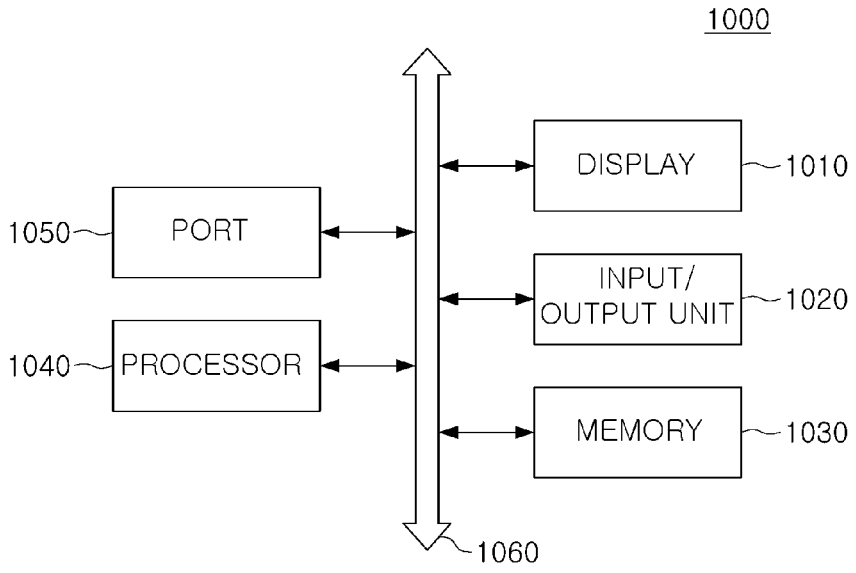
FIG. 15 is a block diagram illustrating an electronic device including a display device according to an example embodiment of the present disclosure.

FIG. 15 is a block diagram illustrating an electronic device including a display device according to an example embodiment of the present disclosure.

Referring to FIG. 15, an electronic device 1000 according to an example embodiment of the present disclosure may include a display 1010, an input/output unit 1020, a memory 1030, a processor 1040, a port 1050, and the like. The electronic device 1000 may include a television, a desktop computer, and the like in addition to a mobile device such as a smartphone, a table PC, a laptop computer, and the like. Components such as the display 1010, the input/output unit 1020, the memory 1030, the processor 1040, the port 1050, and the like may communicate with each other via a bus 1060.

The display 1010 may include a display driver and a display panel. In an example embodiment, the display driver may display image data transmitted by the processor 1040 via the bus 1060 on the display panel depending on the operating mode. The display driver may generate gamma voltages corresponding to the number of bits of the image data transmitted by the processor 1040, and may select at least one of the gamma voltages, according to the image data, to input the selected gamma voltage to the output buffers.

In an example embodiment of the present disclosure, the first image data stored in the first latch and the second image data stored in the second latch may be compared to determine whether to activate the pre-charge function. In addition, by implementing the pre-charge circuit for providing the pre-charge function inside the output buffer, the circuit area occupied by the output buffer may be significantly reduced while the slew rate of the output buffer may be improved.

As set forth above, in the case of a display driver according to an example embodiment of the present disclosure may compare first image data stored in a first latch and second image data stored in a second latch to determine whether to increase or decrease an output voltage of an output buffer in advance. In addition, by connecting a pre-charge circuit between an input stage and an output stage of the output buffer, pre-charge performance may be improved and an increase in a circuit area of the output buffer may be significantly reduced.

As is traditional in the field, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the disclosure. Likewise, the blocks of the embodiments may be physically combined into more complex blocks without departing from the scope of the disclosure.

While example embodiments have been shown and described above, it will be apparent to those skilled in the art that modifications and variations could be made without departing from the scope of the present disclosure as defined by the appended claims.

What is claimed is:

1. A display driver comprising:

a first latch that stores first image data;

a second latch that stores second image data and outputs the second image data to the first latch;

a buffer including a plurality of output buffers that each outputs a source voltage corresponding to the first image data, each of the plurality of output buffers including an input stage, an output stage, and a pre-charge circuit connected between the input stage and the output stage; and a pre-charge controller that compares the first image data with the second image data to control the pre-charge circuit.

2. The display driver of claim 1, wherein the first latch is a holding latch and the second latch is a sampling latch.

3. The display driver of claim 1, further comprising a decoder that inputs at least one of a plurality of gamma voltages to the input stage, based on the first image data during a first period, and that inputs at least one of the plurality of gamma voltages to the input stage, based on the second image data during a second period subsequent to the first period.

4. The display driver of claim 1, wherein:

the output stage comprises a first switch element that receives a first power voltage and a second switch element that receives a second power voltage lower than the first power voltage, and the pre-charge circuit comprises a first pre-charge element controlling the first switch element and a second pre-charge element controlling the second switch element.

5. The display driver of claim 4, wherein the pre-charge controller controls turn-on time and turn-off time of the first pre-charge element and turn-on time and turn-off time of the second pre-charge element, based on a difference between the first image data and the second image data.

6. The display driver of claim 4, wherein the pre-charge controller outputs a first pre-charge control signal controlling the first pre-charge element and a second pre-charge control signal controlling the second pre-charge element.

7. The display driver of claim 4, wherein the pre-charge controller turns-on the first pre-charge element and turns-off the second pre-charge element, when a first source voltage corresponding to the first image data is lower than a second source voltage corresponding to the second image data.

8. The display driver of claim 4, wherein the pre-charge controller turns-off the first pre-charge element and turns-on the second pre-charge element, when a first source voltage corresponding to the first image data is higher than a second source voltage corresponding to the second image data.

9. The display driver of claim 1, wherein the pre-charge controller compares the first image data with the second image data, bit-by-bit, to generate control data for controlling the pre-charge circuit.

10. The display driver of claim 9, wherein the first image data and the second image data have N (N is a natural number) bits and the control data has M (M is a natural number smaller than N) bits.

11. The display driver of claim 10, wherein the pre-charge controller compares:

upper bits of the first image data and upper bits of the second image data with each other to determine a lower bit of the control data, and lower bits of the first image data and lower bits of the second image data with each other to determine an upper bit of the control data.

12. The display driver of claim 9, wherein the pre-charge controller selects at least one bit of the first image data to generate first comparison data, selects at least one bit of the second image data to generate second comparison data, and compares the first comparison data with the second comparison data to generate control data for controlling the pre-charge circuit.

13. The display driver of claim 12, wherein the pre-charge controller generates:

the first comparison data by excluding at least one lower bit of the first image data, and the second comparison data by excluding at least one lower bit of the second image data.

14. A display driver comprising:

an output buffer outputting a first source voltage corresponding to first image data during a first period and outputting a second source voltage corresponding to second image data during a second period subsequent to the first period;

a first latch storing the first image data;

a second latch storing the second image data and outputting the second image data to the first latch; and a pre-charge controller comparing at least one bit of the first image data with at least one bit of the second image data, bit by bit, to increase or decrease an output voltage of the output buffer.

15. The display driver of claim 14, wherein:

each of the first image data and the second image data comprises N (N is a natural number) bits, and the pre-charge controller selects L (L is a natural number smaller than N) upper bits from the first image data to generate first comparison data and selects L upper bits from the second image data to generate second comparison data.

16. The display driver of claim 15, wherein the pre-charge controller:

divides bits of each of the first comparison data and the second comparison data into a plurality of unit groups, and compares the first comparison data with the second comparison data for each of the plurality of unit groups to generate control data.

17. The display driver of claim 16, wherein:

the control data comprises M (M is a natural number smaller than L) bits, and the pre-charge controller determines a time for increasing or decreasing the output voltage of the output buffer, based on the control data, when the second period starts.

18. The display driver of claim 14, wherein the output buffer comprises a pre-charge circuit that increases or decreases the output voltage of the output buffer in response to a control signal of the pre-charge controller, when the second period starts.

19. An output buffer comprising:

an output stage including a first switch element connected between a first power node and an output node and a second switch element connected between a second power node and the output node, the output stage outputs a first source voltage corresponding to first image data during a first period through the output node and outputs a second source voltage corresponding to second image data during a second period subsequent to the first period;

a first pre-charge element connected between a control terminal of the first switch element and the second power node; and a second pre-charge element connected between a control terminal of the second switch element and the first power node, wherein a pre-charge controller compares the first image data with the second image data to control the first pre-charge element and the second pre-charge element.

20. The output buffer of claim 19, wherein:

the first pre-charge element and the second switch element are negative-channel metal-oxide semiconductor (NMOS) transistors, and the second pre-charge element and the first switch element are positive-channel metal-oxide semiconductor (PMOS) transistors.

* * * * *